US005689829A

United States Patent [19]

Rose

[11] Patent Number: 5,689,829

[45] Date of Patent: Nov. 25, 1997

[54] UPPER BODY GARMENT WITH CONCEALED ACCESS PORT AND CONCEALMENT METHOD

[75] Inventor: Walter T. Rose, Houston, Tex.

[73] Assignee: Rose & Boone, Inc., Houston, Tex.

[21] Appl. No.: 634,977

[22] Filed: Apr. 19, 1996

[51] Int. Cl.[6] ..... A41B 1/00; A41D 13/00

[52] U.S. Cl. ..... 2/77; 2/115; 2/94

[58] Field of Search ..... 2/77, 108, 102, 2/115, 79, 69, 247, 106, 104, 2.5, 85, 93, 94, 250–254, DIG. 1

[56] References Cited

U.S. PATENT DOCUMENTS 2,078,461 4/1937 Siegel ..... 2/247
3,537,108 11/1970 Daniels .
4,446,573 5/1984 Green ..... 2/247
4,860,388 8/1989 Dean .
5,379,461 1/1995 Wilmers .
5,509,147 4/1996 Busquets ..... 2/247

*Primary Examiner*—Gloria Hale
*Attorney, Agent, or Firm*—John R. Casperson

[57] ABSTRACT

There is provided a method for accessing a handgun concealed beneath an upper body garment. The method is carried out by providing the upper body garment with an access port through a front portion of the garment. A panel is provided in covering relationship with the access port. A portion of a perimeter of the panel is secured to the garment with a releasible fastener. A portion of the perimeter of the panel is released to expose the access port and the handgun is then accessed through the access port. A garment suitable for carrying out the invention is further disclosed, as is a method for concealing a handgun with the garment.

20 Claims, 2 Drawing Sheets

UPPER BODY GARMENT WITH CONCEALED ACCESS PORT AND CONCEALMENT METHOD

BACKGROUND OF THE INVENTION

In one aspect, the invention relates to a garment. In another aspect, the invention relates to a garment for concealing a weapon. In yet another aspect, the invention relates to methods for concealing and accessing weapons.

Texas Law and the law of other states as well requires that persons carrying handguns keep them concealed. This normally requires that the carrier wear a jacket or coat, conceal the handgun in a carrier such as a purse or fanny pack, or strap the handgun to their leg.

Jackets, coats, purses, or fanny packs, however, are sometimes either uncomfortable or inappropriate attire and under such circumstances may arouse suspicion. For example, in Texas, fisherman seldom wear jackets or coats. During the summer months in Texas, most people do not wear jacket or coats. Also in Texas, men carrying purses or fanny packs may be regarded with some suspicion.

The problem caused by inappropriate attire can sometimes be avoided by strapping the handgun to the leg of the user. However, only small handguns are well suited for concealment in this manner, and a handgun concealed in this manner is not always conveniently accessible. Sometimes a larger handgun could be desirable, as well as a more accessible handgun.

A technique for concealing a handgun of any desired size where it could be conveniently, quickly and surprisingly accessed from attire which does not arouse suspicion would be very desirable.

It is an object of this invention to provide a method for accessing a hidden handgun which is convenient, fast, and surprising.

It is another object of this invention to provide a method for concealing a handgun in a manner in which nothing looks out of the ordinary.

It is further object of this invention to provide an ordinary-looking garment which can be used to conceal a handgun while maintaining good access to the handgun.

SUMMARY OF THE INVENTION

In accordance with one embodiment of the invention, them is provided a method for accessing a handgun concealed beneath an upper body garment. The method is carried out by providing the upper body garment with an access port through a front portion of the garment. A panel is provided in covering relationship with the access port. A portion of a perimeter of the panel is secured to the garment with a releasible fastener. A portion of the perimeter of the panel is released to expose the access port and the handgun is then accessed through the access port.

In a preferred embodiment, the upper body garment has the appearance of a shirt. The panel has the appearance of a breast pocket on the shirt. The breast pocket is secured to the shirt with Velcro® hook and loop fastener strips along the inside and lower edges. The Velcro® hook and loop fastener is released by the user grasping the inside lower corner of the pocket and peeling it back, using the hand on the same side of the shirt as the pocket. Simultaneously, the user reaches in through the access port thus exposed to access the handgun. Elapsed time to produce the handgun is easily under 2 seconds. Since handgun concealment under the front part or side of a shirt is totally unconventional, the overall effect is very fast and very surprising.

In another embodiment of the invention, there is provided a method for concealing a handgun. The method is carried out by providing a handgun, providing a carrying device for the handgun, securing the carrying device to the upper body of a user, and securing the handgun to the carrying device. The upper body of the user is then covered with a shirt-like garment for the upper body having a covered access port for access beneath the garment. The carrying device for the handgun is secured to the upper body of the user in close proximity to the covered access port. The garment has a body portion and breast pocket outer panel portion. The body portion has a front body portion and a back body portion. The front body portion has a front surface and a back surface and defines the access port. The breast pocket outer panel portion is positioned on the front body portion in covering relationship with the access port. The breast pocket outer panel portion has an upper edge, a lower edge, an inner edge, an outer edge, a front surface, and a back surface. The outer edge of the breast pocket outer panel portion is securely fastened to the front body portion of the garment and the inner edge of the breast pocket outer panel portion is releasibly fastened to the front body portion of the garment.

In further embodiment of the invention, there is provided a garment for the upper body having a covered access port for access beneath the garment. The garment has a body portion and breast pocket outer panel portion. The body portion has a front body portion and a back body portion. The front body portion has a front surface and a back surface and defines the access port. The breast pocket outer panel portion is positioned on the front body portion in covering relationship with the access port. The breast pocket outer panel portion has an upper edge, a lower edge, an inner edge, an outer edge, a front surface, and a back surface. The outer edge of the breast pocket outer panel portion is securely fastened to the front body portion of the garment. The inner edge of the breast pocket outer panel portion is releasibly fastened to the front body portion of the garment.

DETAILED DESCRIPTION OF THE INVENTION

Figure 1:
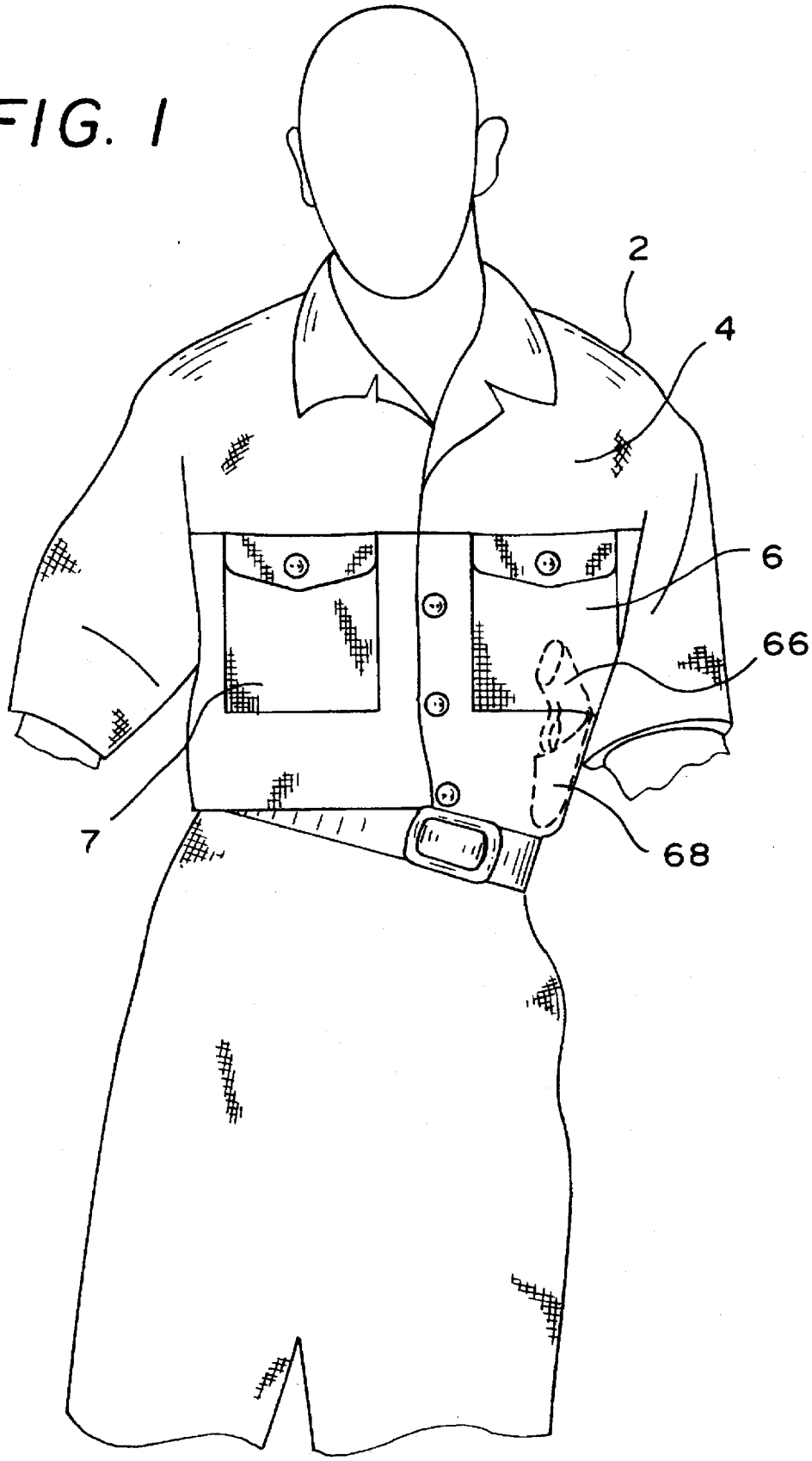
FIG. 1 is a pictorial representation of a shirt embodying certain features of the present invention.

With reference to FIG. 1, in accordance with one embodiment of the invention, a garment 2 for the upper body has a body portion 4 and a breast pocket outer panel portion 6. The body portion 6 has a front body portion shown in FIG. 1 and a back body portion (not shown). The front body portion 6 has a front surface shown in FIG. 1 and a back surface (not shown) and defines an access port 8 (see FIG. 3). The breast pocket outer panel portion 6 is positioned on the front body portion 4 in covering relationship with the access port, as appears in FIGS. 1 and 2.

Figure 2:
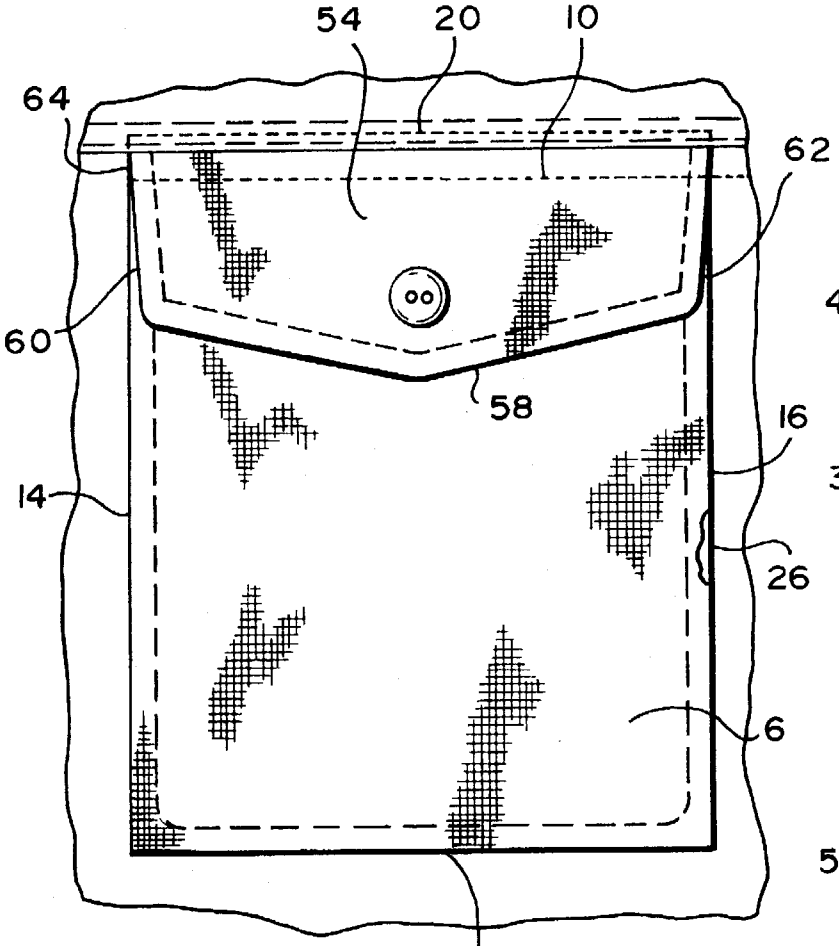
FIG. 2 is a pictorial representation of a portion of the shirt shown in FIG. 1.

With reference to FIG. 2, the breast pocket outer panel portion 6 has an upper edge 10 (dotted line), a lower edge 12, an inner edge 14, an outer edge 16, a front surface (shown), and a back surface (not shown). The outer edge 16 of the breast pocket outer panel portion 6 is securely fastened to the front body portion 4 of the garment, such as, as illustrated, by stitching. The inner edge 14 of the breast pocket outer panel portion is releasibly fastened to the front body portion of the garment, such as by the technique hereinafter described. Preferably, the lower edge 12 of the breast pocket outer panel portion is also releasibly fastened to the front body portion of the garment. In a preferred embodiment of the invention, the garment comprises a shirt and the breast pocket outer panel portion forms a portion of a breast pocket on the shirt. The shirt preferably has a collar. The breast pocket is positioned in covering relationship with the access port and is formed by a breast pocket inner panel portion 18 (see FIG. 3) which is positioned in side by side relationship with the breast pocket outer panel portion. When the pocket is secured as shown in FIG. 2, the breast pocket inner panel portion is positioned between the breast pocket outer panel portion and the access port.

Figure 3:
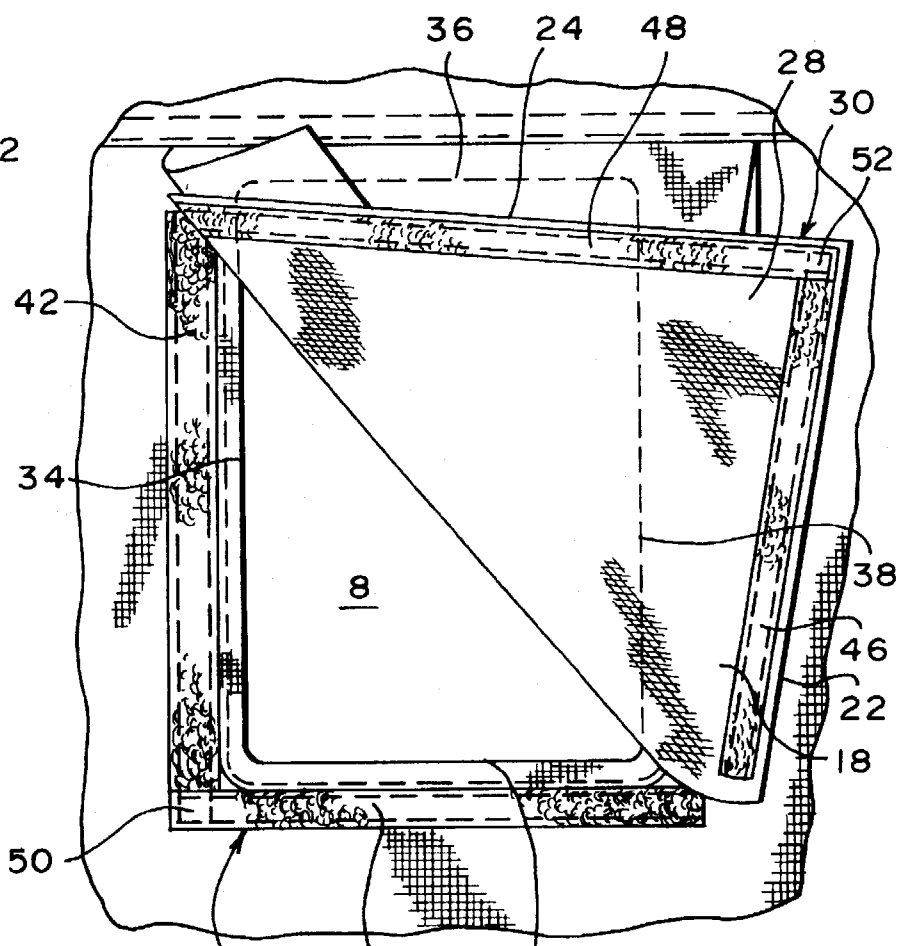
FIG. 3 is a pictorial representation of the portion of the shirt shown in FIG. 2 positioned in another configuration.

With reference to FIG. 3, the breast pocket inner panel portion 18 has an upper edge 20 (dotted line, FIG. 2), a lower edge 22 (FIG. 3), an inner edge 24, an outer edge 26, a front surface (not shown), and a back surface 28 (FIG. 3). The front side of the breast pocket inner panel portion faces the back side of the breast pocket outer panel portion and the inner edge of the breast pocket inner panel portion is securely fastened to the inner edge of the breast pocket outer panel portion, the lower edge of the breast pocket inner panel portion is securely fastened to the lower edge of the breast pocket outer panel portion, and the outer edge of the breast pocket inner panel portion is securely fastened, such as by stitching, to the outer edge of the breast pocket outer panel portion to form the pocket. Preferably, the upper edge 20 of the breast pocket inner panel portion 18 is securely fastened to the front body portion of the garment and the inner edge 24 of the breast pocket inner panel portion is releasibly fastened to the front body portion of the garment.

Preferably, the releasible fastening is accomplished by means forming releasible fastener halves. At least one means 30 forming a releasible fastener half is secured to the back surface of the breast pocket inner panel portion adjacent to the lower edge 22 of the breast pocket inner panel portion and adjacent to the inside edge 24 of the breast pocket inner panel portion. A complementing at least one means 32 forming a releasible fastener half is secured to the front side of the front body portion of the garment in underlying relationship with the at least one means 30. More preferably, at least one of the at least one means 30 and 32 forming the releasible fastener halves comprises a plurality of hooks and the complementing means comprises a plurality of pile elements which when placed in overlapping face to face relationship with the means comprising the plurality of hooks interengages therewith and resists separation. Suitable fastener halves are commercially available under the Trademark Velcro® brand hook and loop fasteners.

The preferred fasteners are available in bands or tapes of complementing fastener halves. The access port 8 can be defined by an inner edge 34, and upper edge 36 (dotted line, FIG. 3), an outer edge 38 (dotted line, FIG. 3) and a lower edge 40. A band 42 of a releasible fastener half is secured to the front side of the front body portion alongside the inner edge 34 of the access port 8 and a band 44 of a releasible fastener half is secured to the front side of the front body portion alongside the lower edge 40 of the access port 8. A complementing band 46 of a releasable fastener half is secured to the back surface of the breast pocket inner panel portion 28 adjacent to the lower edge 22 of the breast pocket inner panel portion. A complementing band 48 of a releasable fastener half is secured to the back surface of the breast pocket inner panel portion 28 adjacent to the inner edge 24 of the breast pocket inner panel portion. The bands 46 and 48 are positioned for covering face to face relationship with the bands 42 and 44 to releasibly fasten the inner edge and the lower edge of the breast pocket inner panel portion to the front side of the front body portion of the garment. Preferably, the band 42 and the band 44 join at a corner 50 and the complementing band 44 and the complementing band 46 join at a corner 52. The bands resist separation by forces substantially parallel to an interfacial plane of engagement between the bands yet are readily separable by peeling forces applied substantially normal to the interfacial plane from the corners where the bands are joined. The access port 8 is easily exposed by peeling the panels away from the garment from a point beginning from the corner where the bands are joined.

With reference to FIG. 2, a preferred garment constructed in accordance with the invention further comprises a breast pocket cover flap 54 positioned in covering relationship with the upper edge 10 of the breast pocket outer panel. The cover flap 54 has an upper edge (not shown, positioned alongside the edge 20), a lower edge 58, an inner edge 60 and an outer edge 62. The cover flap 54 is securely fastened adjacent to its upper edge to the front body portion of the front side of the garment. Preferably, a tab portion 64 of the breast pocket inner panel portion 28 protrudes past the upper edge 10 of the breast pocket outer panel portion to provide an area to fasten the pocket to the garment. As shown by FIG. 1, a pocket 7 can be affixed to the an opposite front side portion of the garment to give the appearance of a pair of pockets on an apparently ordinary shirt.

As suggested in FIG. 1, when the garment is used, a handgun 66 is preferably positioned in close proximity to the access port. The handgun 66 is preferably secured in a carrying device 68, such as a holster, which is in turn secured to the upper body of the user. A wide variety of carrying devices can be used. For example, the carrying device can comprise a shoulder harness and holster, a torso band and holster, or a bullet-proof vest and holster. Shoulder harnesses are well known. A torso band can be constructed from a wide elastic material such as is sold under the trademark Lycra® brand stretchable fabric with the holster sewn thereto. A holster can be sewn, or fastened such as with Velcro® brand and loop fasteners or duct tape, to a bullet proof vest. The orientation of the holster can be at the option of the user. It is generally believed, however, that large handguns should be positioned barrel down, grip forward, on the weak side of the user for best concealment and accessibility.

While certain preferred embodiments of the invention have been shown and described herein, the invention is not to be construed as so limited, except to the extent that such limitations are found in the claims.

What is claimed is:

1. A shirt-like garment for the upper body having a covered access port for access beneath the garment, said garment having a body portion and breast pocket outer panel portion, said body portion having a front body portion and a back body portion, the front body portion having a front surface and a back surface and defining the access port, the breast pocket outer panel portion being positioned on the front body portion in covering relationship with the access port, said breast pocket outer panel portion having an upper edge, a lower edge, an inner edge, an outer edge, a front surface, and a back surface, the outer edge of the breast pocket outer panel portion being securely fastened to the front body portion of the garment, and the inner edge of the breast pocket outer panel portion being releasibly fastened to the from body portion of the garment.

2. A garment as in claim 1 wherein the lower edge of the breast pocket outer panel portion is releasibly fastened to the front body portion of the garment.

3. A garment as in claim 2 further comprising a breast pocket inner panel portion positioned in side by side relationship with the breast pocket outer panel portion between the breast pocket outer panel portion and the access port, said breast pocket inner panel portion having an upper edge, a lower edge, an inner edge, an outer edge, a front surface, and a back surface, the front side of the breast pocket inner panel portion facing the back side of the breast pocket outer panel portion, the inner edge of the breast pocket inner panel portion being securely fastened to the inner edge of the breast pocket outer panel portion, the lower edge of the breast pocket inner panel portion being securely fastened to the lower edge of the breast pocket outer panel portion, and the outer edge of the breast pocket inner panel portion being securely fastened to the outer edge of the breast pocket outer panel portion, said breast pocket inner panel portion and said breast pocket outer panel portion together forming a breast pocket positioned in covering relationship with the access port.

4. A garment as in claim 3 wherein the upper edge of the breast pocket inner panel portion is securely fastened to the front body portion of the garment and the inner edge of the breast pocket inner panel portion is releasibly fastened to the front body portion of the garment.

5. A garment as in claim 4 wherein at least one means forming a releasible fastener half is secured to the back surface of the breast pocket inner panel portion adjacent to the lower edge of the breast pocket inner panel portion and adjacent to an inside edge of the breast pocket inner panel portion and a complementing at least one means forming a releasible fastener half is secured to the front surface of the front body portion of the garment in underlying relationship with the at least one means forming a releasible fastener half secured on the back surface of the breast pocket inner panel portion.

6. A garment as in claim 5 wherein at least one of the at least one means forming the releasible fastener halfs comprises a plurality of hooks and the complementing means comprises a plurality of pile elements which when placed in overlapping face to face relationship with the means comprising the plurality of hooks interengages therewith and resists separation.

7. A garment as in claim 4 wherein the access port is defined by an inner edge, an upper edge, an outer edge and a lower edge, said garment having a band of a releasible fastener half secured to the front surface of the front body portion alongside the inner edge of the access port and the lower edge of the access port and a complementing band of a releasable fastener half secured to the back surface of the breast pocket inner panel portion adjacent to the lower edge of the breast pocket inner panel portion and the inner edge of the breast pocket inner panel portion in covering face to face relationship with the band of the releasible fastener half secured to the front surface of the front body portion of the garment, wherein one of the bands of the releasible fastener halfs comprises a plurality of hooks and the other comprises a plurality of pile elements which are interengaged with the hook elements to releasibly fasten the inner edge and the lower edge of the breast pocket inner panel portion to the front surface of the front body portion of the garment.

8. A garment as in claim 7 further comprising a breast pocket cover flap having an upper edge, a lower edge, an inner edge and an outer edge positioned in covering relationship with the upper edge of the breast pocket outer panel and securely fastened adjacent to its upper edge to the front surface of the front body portion of the garment.

9. A garment as in claim 8 wherein a tab portion of the breast pocket inner panel portion protrudes past the upper edge of the breast pocket outer panel portion.

10. A method for concealing a handgun comprising providing a handgun, providing a carrying device for the handgun, securing the carrying device to the upper body of a user, securing the handgun to the carrying device, covering the upper body of the user with a shirt-like garment for the upper body having a covered access port for access beneath the garment, wherein the carrying device for the handgun is secured to the upper body of the user in close proximity to the covered access port, said garment having a body portion and breast pocket outer panel portion, said body portion having a front body portion and a back body portion, the front body portion having a front surface and a back surface and defining the access port, the breast pocket outer panel portion being positioned on the front body portion in covering relationship with the access port and having an upper edge, a lower edge, an inner edge, an outer edge, a front surface, and a back surface, the outer edge of the breast pocket outer panel portion being securely fastened to the front body portion of the garment, and the inner edge of the breast pocket outer panel portion being releasibly fastened to the front body portion of the garment.

11. A method as in claim 10 wherein the carrying device comprises a shoulder harness and holster.

12. A method as in claim 10 wherein the carrying device comprises a torso band and holster.

13. A method as in claim 10 wherein the carrying device comprises a bullet-proof vest and holster.

14. A method as in claim 10 wherein the lower edge of the breast pocket outer panel portion is releasibly fastened to the front body portion of the garment.

15. A method for accessing a handgun concealed beneath an upper body garment, said method comprising providing the upper body garment with an access port through a front portion of the garment, providing a panel in covering relationship with the access port, securing a portion of a perimeter of the panel to the garment with a releasible fastener, releasing a portion of the perimeter of the panel to expose the access port; and accessing the handgun through the access port.

16. A method as in claim 15 wherein the perimeter of the panel has an inner perimeter portion and a lower perimeter portion which are secured to the garment with the releasible fastener.

17. A method as in claim 16 wherein the releasible fastener comprises a first band of a releasible fastener half secured to a back side of the panel adjacent to the inner perimeter portion, a second band of a releasible fastener half secured to a back side of the panel adjacent to the lower perimeter portion, a complementing first band of a releasable fastener half secured to the front side of the garment beneath the first band of the releasible fastener half, and a complementing second band of a releasible fastener half secured to the front side of the garment beneath the second band of the releasible fastener half, wherein the first band and the second band join at a corner and the complementing first band and the complementing second band join at a corner, wherein one of the bands of the releasible fastener halfs comprises a plurality of hooks and the other comprises a plurality of pile elements which are interengaged with the hook elements and resist separation by forces substantially parallel to an interfacial plane of engagement between the bands and are readily separable by peeling forces applied substantially normal to the interfacial plane from the corner where the first band is joined to the second band.

18. A method as in claim 17 further comprising peeling the panel away from the garment from a point beginning from the corner where the first band is joined to the second band to expose the access port.

19. A method as in claim 18 wherein the handgun is positioned in close proximity to the access port.

20. A method as in claim 19 wherein the garment comprises a shirt and the panel forms a portion of a breast pocket on the shirt.

* * * * *